US009167899B2

(12) United States Patent
Jackson

(10) Patent No.: US 9,167,899 B2
(45) Date of Patent: Oct. 27, 2015

(54) SLEIGH-TYPE ROCKING CHAIR AND METHOD OF MANUFACTURE

(71) Applicant: DP Jackson Woodworks, Inc., Prosper, TX (US)

(72) Inventor: Daniel P. Jackson, Prosper, TX (US)

(73) Assignee: Mono-Parts Technology LLC, Gunter, TX (US)

( * ) Notice: Subject to any disclaimer, the term of this patent is extended or adjusted under 35 U.S.C. 154(b) by 101 days.

(21) Appl. No.: 14/070,534

(22) Filed: Nov. 2, 2013

(65) Prior Publication Data

US 2014/0125100 A1 May 8, 2014

Related U.S. Application Data

(60) Provisional application No. 61/721,489, filed on Nov. 2, 2012.

(51) Int. Cl.

| | |
|---|---|
| ***A47C 3/029*** | (2006.01) |
| ***A47C 3/02*** | (2006.01) |
| *B27M 3/18* | (2006.01) |

(52) U.S. Cl.

CPC . *A47C 3/029* (2013.01); *A47C 3/02* (2013.01); *B27M 3/18* (2013.01); *Y10T 29/49936* (2015.01); *Y10T 29/49945* (2015.01)

(58) Field of Classification Search

CPC .... A47C 3/02; A47C 3/027; Y10T 29/49936; Y10T 29/49945; F16B 12/00; B27M 1/05; B27M 3/18; B27C 9/00

See application file for complete search history.

(56) References Cited

U.S. PATENT DOCUMENTS

| | | | | |
|---|---|---|---|---|
| 3,909,064 | A * | 9/1975 | Payne et al. | 297/440.23 |
| 4,786,106 | A | 11/1988 | Bottemiller | |
| 5,407,250 | A * | 4/1995 | Prince et al. | 297/440.2 |
| 6,979,059 | B1 | 12/2005 | Conlin | |
| 7,296,859 | B1 * | 11/2007 | Branch, III et al. | 297/440.23 |
| 8,070,229 | B2 | 12/2011 | Woodring | |
| 8,104,839 | B2 * | 1/2012 | Huang | 297/440.1 |
| 2008/0073958 | A1 * | 3/2008 | Bellin | 297/261.2 |
| 2012/0280550 | A1 * | 11/2012 | College | 297/411.2 |

* cited by examiner

*Primary Examiner* — Sarang Afzali
*Assistant Examiner* — Ruth G Hidalgo-Hernande
(74) *Attorney, Agent, or Firm* — Corridor Law Group, P.C.

(57) ABSTRACT

A sleigh-type rocking chair includes a pair of armrest/stile/riser assemblies joined to a pair of rocker/leg assemblies, a seat joined by mortise and tenon joints to the armrest/stile/riser assemblies, a front stretcher and a rear stretcher joined to each of the rocker/leg assemblies, a crest rail joined to an upper portion of the armrest/stile/riser assemblies, and a plurality of spindles joined to and extending upwardly from the seat and joined on the other end of the spindle to the crest rail. The assemblies, stretchers, seat, spindles and crest rail are preferably formed using a computer numerical control cutting device.

3 Claims, 4 Drawing Sheets

SLEIGH-TYPE ROCKING CHAIR AND METHOD OF MANUFACTURE

CROSS-REFERENCE TO RELATED APPLICATION

This application is related to and claims priority benefits from U.S. Provisional Patent Application Ser. No. 61/721,489 filed Nov. 2, 2012, entitled "Sleigh-Type Rocking Chair And Method Of Manufacture". The '489 provisional application is hereby incorporated by reference herein in its entirety.

FIELD OF THE INVENTION

The present invention relates to furniture manufacturing. In particular, the present invention relates to the manufacture of a sleigh-type rocking chair.

BACKGROUND OF THE INVENTION

The length of time required to manufacture a sleigh-type rocking chair (trade name SleighRocker™) is excessive. Current production methods absorb over 100 man-hours per chair, thereby making it expensive. The underlying problem is the method used to form the wood into the curved pieces which define the lines of the chair, making it resemble a sleigh. Thin wood pieces are steam-bent, formed and laminated to create the shape of the sleigh. By refining this method of parts formation to the extent that the parts become mass producible, the potential exists to greatly reduce the amount of time required to produce a chair, thereby making the chair far less expensive. This labor and subsequent price reduction has the added effect of exponentially broadening the potential customer base by being able to offer the chairs at a price that is affordable to a larger number of people.

Previous attempts to streamline the production of the sleigh-forming parts include the following approach:

(1) Formation of the parts from solid stock by making precise cuts with a band saw; multiple pieces can be stacked and cut all at once, with the only limitations being the available cutting height of the band saw, and the skill level of the person operating it. This approach creates inherent weak points in pieces where the curvature crosses weaker parts in the grain structure of solid stock wood. This method produces parts more quickly, but the parts it produces are far weaker structurally, and present the potential for liabilities in cases of broken chairs. It also requires individual joints to be cut for each connecting piece.

(2) Formation of the parts by rough-cutting on a band saw, finishing with a router template. This approach is a faster method of producing the structurally inferior parts described above with respect to approach (1) above.

(3) The combination of multiple parts into a single larger part, laminating thin pieces of wood that have been steamed and then promptly bent to form to the sleigh-defining shapes. This approach does not overcome the shortcomings of prior methods because, while it reduces the number of functional parts needed for a single chair, the parts that are needed are more complex to produce with adequate accuracy and structural integrity. The result is a structurally strong chair that has fewer parts and necessary glue joints, but the process of making both the parts and the joints is very time-consuming. This method also has an inherent waste factor of fifty percent or more of the raw wood material, because ⅛" is consumed by the kerf (blade width) of every strip that is cut.

(4) The use of multiple steam boxes, racks and forms. This approach does not overcome the shortcomings of prior methods because the pieces still require over a week to steam, form, dry, glue and then shape by hand. Another shortcoming of this method is the sheer number of individual thin pieces that must be cut, steamed, bent, dried and finally laminated to form a single chair part. This approach is also deficient in that it requires an extra laborer for every steam box in operation; that laborer must be highly skilled in the art of steam-bending.

A computer numerical control (CNC) router, which can serve as an automated wood cutting machine, makes precise cuts that are programmed by computer-aided design (CAD) software. CNC routers are capable of cutting on x-, y- and z-axes. The router motor itself travels on a system of rails to maneuver it about the object being cut. The most sophisticated models are capable of changing cutting tools automatically, when required by the object being produced. By employing computer numerical control wood milling machinery, the component parts that make up the present sleigh-type rocking chair can be accurately cut in rapid succession from pre-laminated stock.

The present sleigh-type rocking chair design and method of manufacture overcomes many shortcomings of prior designs and manufacturing methods.

SUMMARY OF THE INVENTION

A sleigh-type rocking chair comprises:

(a) a pair of armrest/stile/riser assemblies, each of the armrest/stile/riser assemblies joined to a rocker/leg assembly;

(b) a seat joined by mortise and tenon joints to a pair of rocker/leg assemblies;

(c) a front stretcher joined to each of the rocker/leg assemblies, the front stretcher functioning as a monolithic tenon, the tenon joined to mortises formed in each of the rocker/leg assemblies;

(d) a rear stretcher joined to each of the rocker/leg assemblies, the stretcher functioning as a monolithic tenon, the tenon joined to mortises formed in each of the rocker/leg assemblies;

(e) a crest rail joined to an upper portion of the armrest/stile/riser assemblies, the crest rail functioning as a monolithic tenon joined to a mortise formed in each of the armrest/stile/riser assemblies;

(f) a plurality of spindles extending upwardly from mortises in said seat, each of said spindles functioning as a monolithic tenon joined to a mortise formed in said crest rail.

In a preferred embodiment, the armrest/stile/riser assembly has an angled portion formed thereon and the rocker/leg assembly has a cooperating portion formed thereon, the angled and flat joint portions configured to be fastened together.

In a preferred embodiment, the seat has a tenon joint portion formed thereon and the rocker/leg assembly has a mortise joint formed thereon, the mortise and tenon joint portions configured to be press fitted together.

In a preferred embodiment, the exterior surface of each of the spindles is flat.

In a preferred embodiment, the assemblies, stretchers, seat, spindles and crest rail are formed using a computer numerical control cutting device.

A method of forming the components of a sleigh-type rocking chair comprises:

forming a pair of armrest/stile/riser assemblies using a computer numerical control cutting device, each of the armrest/stile/riser assemblies formed having:

a first cooperating part of a joint on a bottom inside portion thereof, and a form-fitted overhang on a bottom inside portion thereof;

forming a pair of rocker/leg assemblies using a computer numerical control cutting device, each of the rocker/leg assemblies having:

a second cooperating part of a joint formed on a top outside portion thereof, the rocker/leg assembly joint part configured to be fastened onto the first cooperating joint part on the bottom inside portion of the armrest/stile/riser assembly, a front mortise formed in a side portion thereof, a rear mortise formed in a side portion thereof;

forming a seat using a computer numerical control cutting device, the seat having:

a second cooperating part of a mortise and tenon joint formed on a side portion thereof, the seat tenon joint part configured to be press fitted into the first cooperating mortise joint part on the side portion of the rocker/leg assembly, and a plurality of mortises formed in a top portion thereof;

forming a front stretcher using a computer numerical control cutting device, the front stretcher to function as a monolithic tenon configured to be press fitted in each of the rocker/leg assembly front mortises;

forming a rear stretcher using a computer numerical control cutting device, the rear stretcher to function as a monolithic tenon configured to be press fitted in each of the rocker/leg assembly rear mortises;

forming a crest rail using a computer numerical control cutting device, the crest rail:

functioning as a monolithic tenon, and having a plurality of mortises formed on the bottom portion thereof;

forming a plurality of spindles using a computer numerical control cutting device, each of the spindles functioning as a monolithic tenon, one end of the tenons configured to be press fitted in one of the seat mortises and the other end of the tenons configured to be press fitted in one of the crest rail mortises.

In a preferred method embodiment, the first cooperating part of the joint on the armrest/stile/riser assembly bottom inside portion is an angled flat joint part and the second cooperating part of the joint formed on the rocker/leg assembly top outside portion is a square flat joint part, the first and second joint parts configured to be fastened together.

In a preferred method embodiment, the first cooperating part of the mortise and tenon joint on the armrest/stile/riser assembly side portion is a mortise joint part and the second cooperating part of the mortise and tenon joint formed on the seat side portion is a tenon joint part, the first and second mortise and tenon parts configured to be press fitted with each other.

DETAILED DESCRIPTION OF PREFERRED EMBODIMENT(S)

Figure 1:
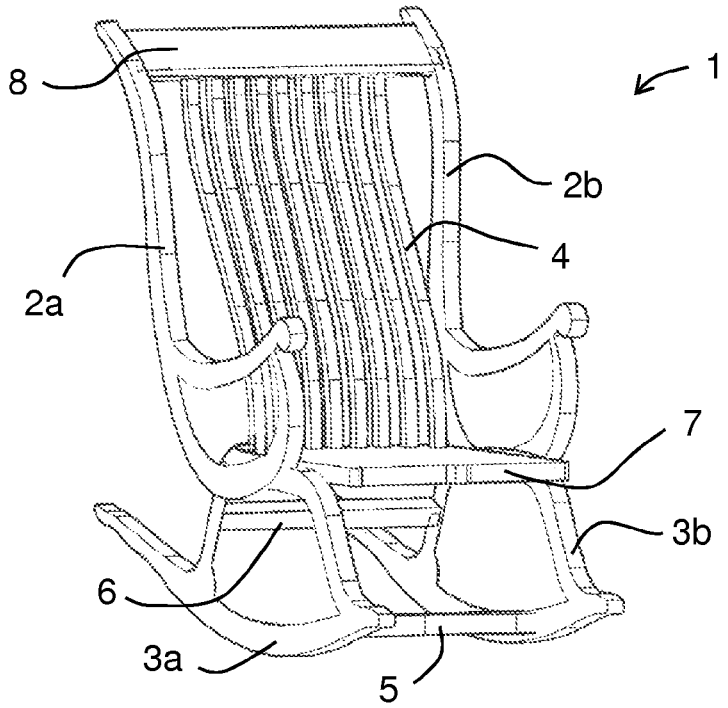
FIG. 1 is a perspective view of the present sleigh-type rocking chair in assembled form.
Figure 2:
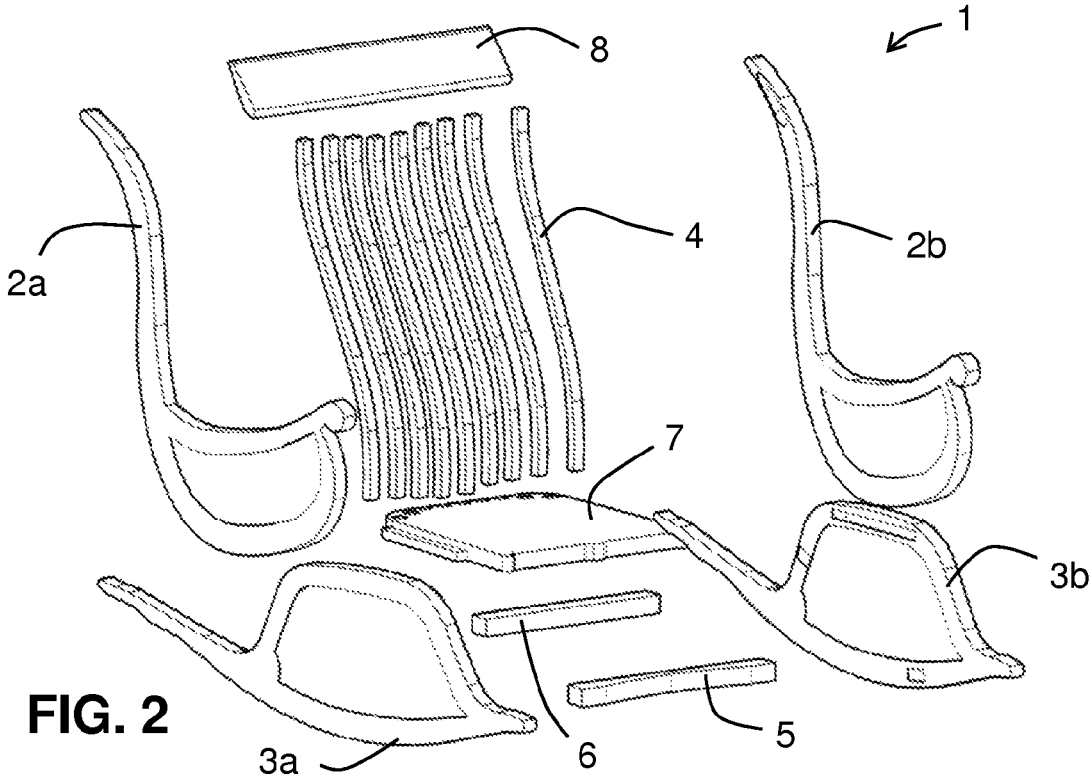
FIG. 2 is an exploded perspective view of the sleigh-type rocking chair illustrated in FIG. 1.

Turning first to FIGS. 1 and 2, sleigh-type rocking chair 1 includes armrest/stile/riser assemblies 2*a* and 2*b*, rocker/leg assemblies 3*a* and 3*b*, a plurality of spindles, one of which is designated in FIGS. 1 and 2 as spindle 4, front stretcher 5, rear stretcher 6, seat assembly 7, and crest rail 8.

Armrest/stile/riser assemblies 2*a* and 2*b* are joined to rocker/leg assemblies 3*a* and 3*b* by screw and glue joints, respectively. Flat screw and glue joint parts are formed at the outside top portion of rocker/leg assemblies 3*a* and 3*b*. Angled screw and glue joint parts are formed in the inside bottom portion of armrest/stile/riser assemblies 2*a* and 2*b*.

Figure 3:
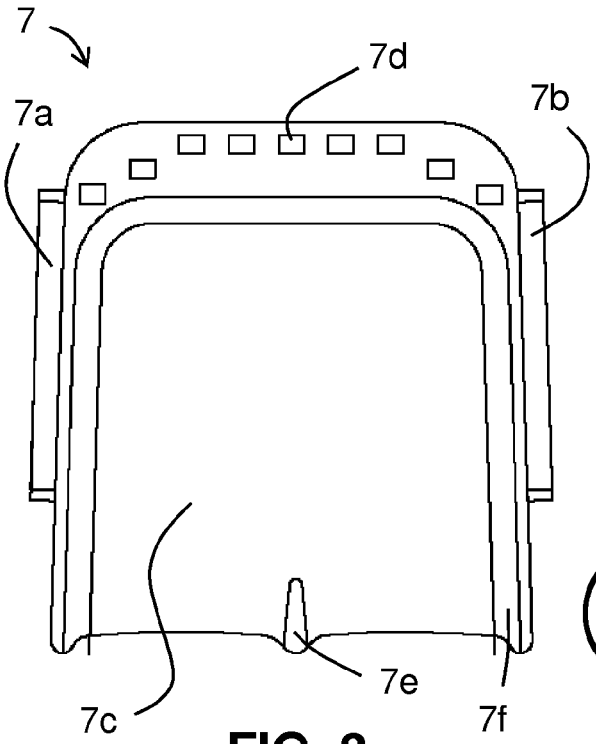
FIG. 3 is a top view of the seat assembly of the sleigh-type rocking chair illustrated in FIG. 1.
Figure 3B:
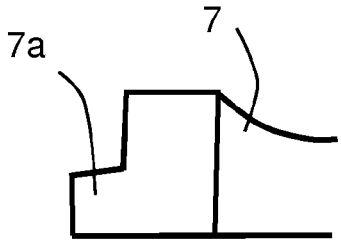
FIG. 3B is an enlarged front view of the seat assembly edge portion circled in FIG. 3A.
Figure 3A:
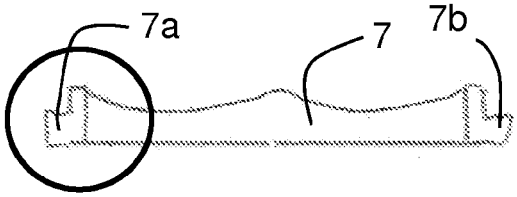
FIG. 3A is a front view of the seat assembly illustrated in FIG. 3.

Turning to FIG. 3, seat assembly 7 includes tenons 7*a* and 7*b*, seat portion 7*c*, a plurality of spindle mortises, one of which is designated as spindle mortise 7*d*, shaped separation portion 7*e* (for conforming to the user's legs), and a sculpted perimeter portion 7*f*. As shown in FIG. 3A, tenons 7*a* and 7*b* extend from opposite sides of seat assembly 7. The seat of the present sleigh-type rocking chair is attached to the rocker/leg assembly by the tenon that is formed onto each side of the seat (see FIGS. 3A and 3B). The sculpted, form-fitting seat is designed to fit the natural shape of the human body. Across the top of the seat along the rear edge is a row of mortises, drilled at precise positions to receive the ends of the flat spindles. Conventional sleigh-type rocking chairs required many hours of manual cutting for the sculpted seat, the flat spindle mortises and the seat attachment joinery. The CNC router provides the seat assembly with precision mortise and tenon joinery and spindle mortises in a matter of seconds.

Figure 4:
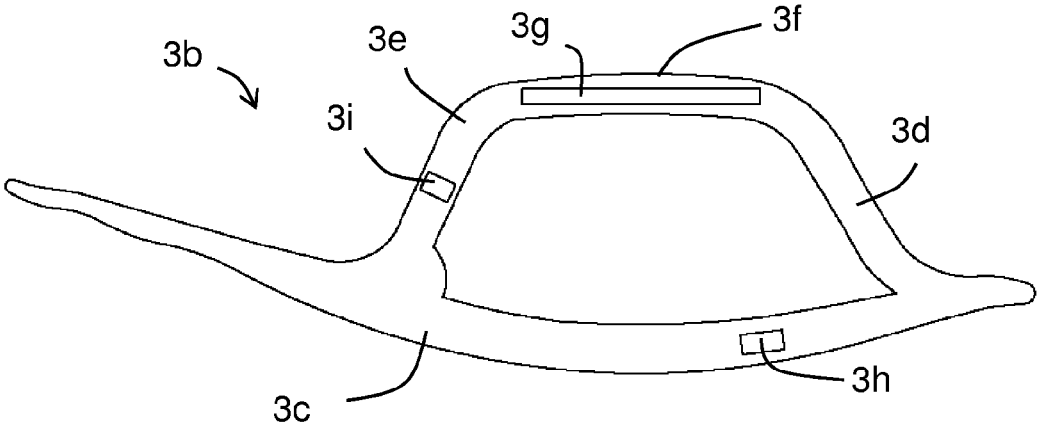
FIG. 4 is a side elevation view of rocker/leg assembly of the sleigh-type rocking chair illustrated in FIG. 1.

As shown in FIG. 4, rocker/leg assembly 3*b* includes rocker portion 3*c*, front leg portion 3*d*, rear leg portion 3*e*, rail portion 3*f*, seat mortise 3*g*, front stretcher mortise 3*h*, and rear stretcher mortise 3*i*. Conventional sleigh-type rocking chairs did not include the rocker as part of the assembly; it had to be steamed, bent, formed and laminated on its own and attached later with precision mortise and tenon joinery to the rocker/leg assembly. The rocker/leg assembly also had to be steamed, bent, formed and laminated on its own prior to its fitment for joinery and subsequent attachment to the rocker assembly. Detail A shows the flat square glue joint formed at the inside top of this assembly which is used for attachment of the assembly to the armrest/stile/riser assembly. The incorporation of these two parts that were previously steamed, bent, formed, laminated and fitted for joinery to one another into a single monolithic assembly is another massive savings of time and labor. This single assembly including the joinery can be cut in a matter of seconds using the CNC Router.

Figure 5:
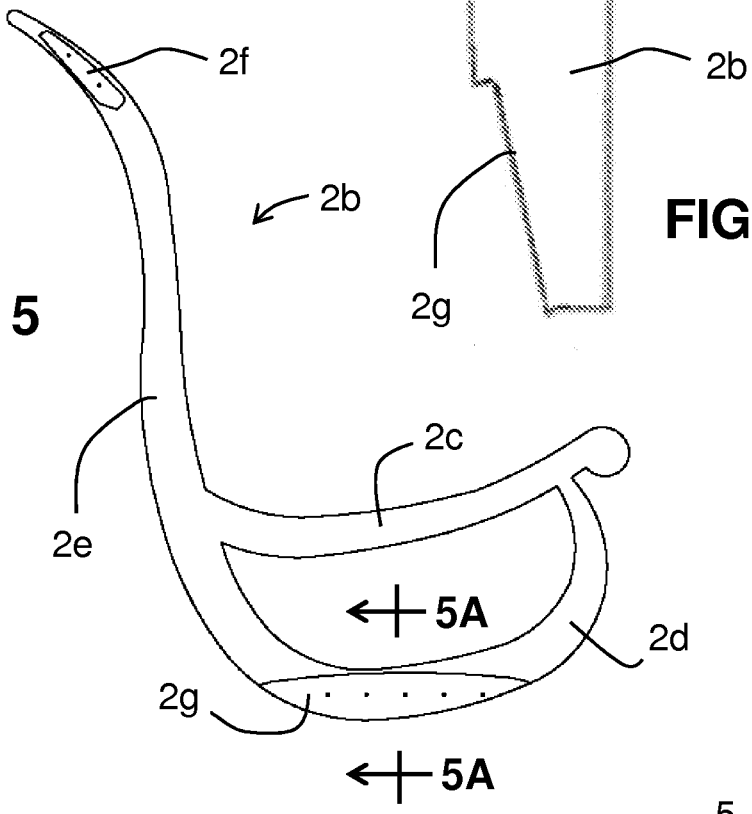
FIG. 5 is a side elevation view of the armrest/stile/riser assembly of the sleigh-type rocking chair illustrated in FIG. 1.
Figure 5A:
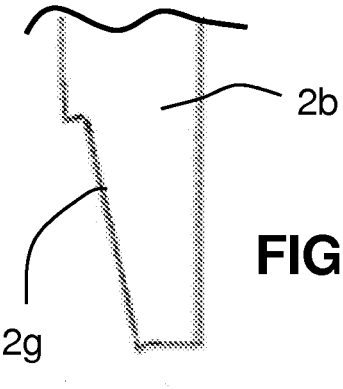
FIG. 5A is an enlarged side view of the armrest/stile/riser assembly taken in the direction of arrows 5A-5A in FIG. 5.

As shown in FIG. 5, armrest/stile/riser assembly 2*b* includes armrest portion 2*c*, riser portion 2*d*, stile portion 2*e*, crest rail mortise 2*f*, and seat cut-out portion 2*g*. Conventional sleigh-type rocking chairs did not include the armrest as part of the assembly; it had to be cut on its own and attached later with precision-cut joinery incorporated into its design. With its inclusion into this monolithic assembly, the need to prepare two precision joints for the armrest's attachment is eliminated, thus creating a time/labor savings. FIG. 5A shows the angled flat glue joint which results in a ¼" overhang of the rocker/leg assembly. This surface is cut into the inside bottom of the assembly on a flat plane that is cut to be preferably +/−4 degrees off vertical to splay the stiles as they rise. By using the CNC router to cut this assembly, including the angled flat glue surface and resulting overhang, a substantial savings of time and labor can be achieved. The very nature of the intersection of compound angles and form-fitting curves requires precision that can only be achieved by the most proficient craftsmen; the CNC router renders it in seconds.

Figure 6:
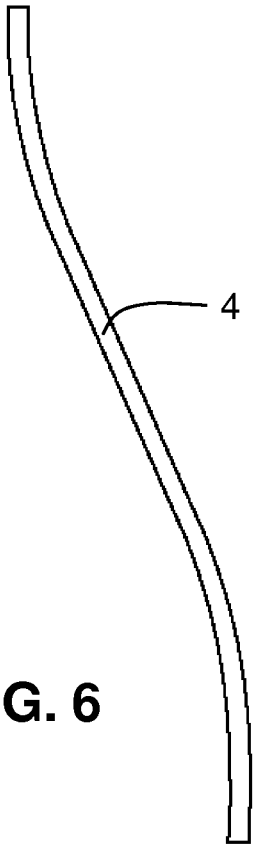
FIG. 6 is a side elevation view of one of the spindles of the sleigh-type rocking chair illustrated in FIG. 1.

FIG. 6 shows a spindle 4, which is one of the plurality of spindles of the present sleigh-type rocking chair. The flat spindles are set between the seat and the crest rail to form the ergonomic contoured back of the present sleigh-type rocking chair. The spindles are attached to the seat and crest rail as a monolithic tenon; each is cut with exacting precision by the CNC Router. In conventional sleigh-type rocking chairs, the spindles were manually cut using a band saw to render the curvature of each piece. The spindles were then individually cut to fit lengthwise to the crest rail and seat; only then could the tenons be formed using a drill-mounted tenon cutter. Each piece had to be cut manually in this manner. Using the CNC router to prepare these pieces will not only eliminate trial and error, but the time required to produce the spindles can be reduced to a matter of seconds.

Figure 7:
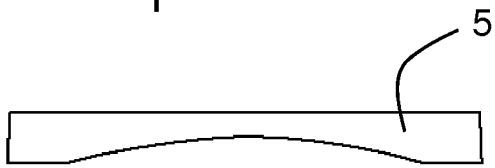
FIG. 7 is a top view of the front stretcher of the sleigh-type rocking chair illustrated in FIG. 1.
Figure 8:
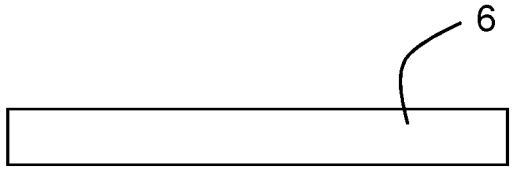
FIG. 8 is a top view of the rear stretcher of the sleigh-type rocking chair illustrated in FIG. 1.

FIGS. 7 and 8 show front stretcher 5 and rear stretcher 6, respectively, of the present sleigh-type rocking chair. The front and rear stretchers of the present sleigh-type rocking chair not only add stability and strength to the overall assembly, but also impart the look of a sleigh. In conventional sleigh-type rocking chairs, the stretchers had to be manually cut and meticulously hand-fitted between the two rocker/leg assemblies. The precise joinery in the present sleigh-type rocking chair allows this piece to be consistently cut substantially identically for each chair, thus reducing time and labor expenses.

Figure 9:
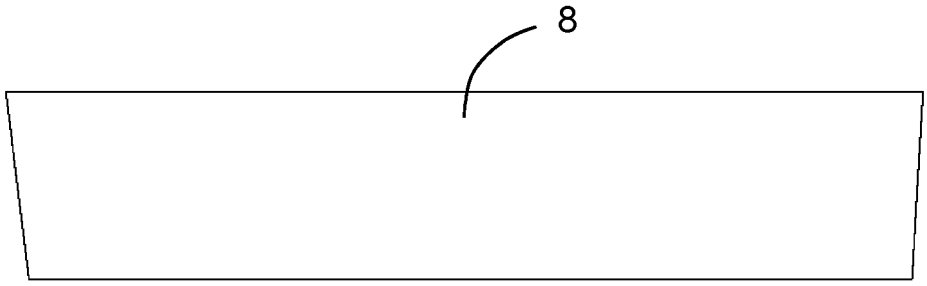
FIG. 9 is a front elevation view of the crest rail of the sleigh-type rocking chair illustrated in FIG. 1.
Figure 10:
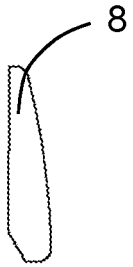
FIG. 10 is a side elevation view of the crest rail of the sleigh-type rocking chair illustrated in FIG. 1.
Figure 11:
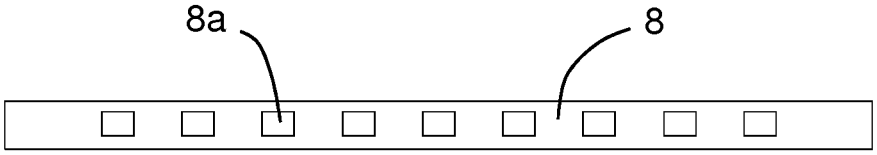
FIG. 11 is a bottom view of the crest rail of the sleigh-type rocking chair illustrated in FIG. 1.

Turning to FIGS. 9-11, crest rail 8 includes on its bottom edge a plurality of spindle mortises, one of which is designated in FIG. 11 as spindle mortise 8*a*. The crest rail of the present sleigh-type rocking chair serves as the headrest, the top of the ergonomic back support, and the top stretcher between the stiles. The crest rail is sculpted to match the top lines of the stiles and drilled with precisely placed mortises on the bottom side to receive the top ends of the flat spindles. Conventional sleigh-type rocking chairs required manual sculpting and mortising of the crest rail.

As shown in FIGS. 2-11 and the detailed descriptions set forth above for the individual components and assemblies of the present sleigh-type rocking chair, seat assembly 7 is joined to rocker/leg assembly 3*b* by the insertion of tenon 7*a* (see FIG. 3) into seat mortise 3*g* (see FIG. 4). Front stretcher 5 is joined to rocker/leg assembly 3*b* by insertion of one end of front stretcher 5 into front stretcher mortise 3*h* (see FIG. 4). Rear stretcher 6 is joined to rocker/leg assembly 3*b* by insertion of one end of rear stretcher 6 into rear stretcher mortise 3*i* (see FIG. 4). Spindle 4 is joined at the bottom end to seat assembly 7 by insertion into seat spindle mortise 7*d* (see FIG. 3). Spindle 4 is joined at the top end to crest rail 8 by insertion into spindle mortise 8*a* (see FIG. 11).

Crest rail 8 is joined to armrest/stile/riser assembly 2*b* by insertion into crest rail mortise 2*f*. Armrest/stile/riser assembly 2*b* is, in turn, joined to rocker/leg assembly 3*b* by positioning cut-out portion 2*g* on the top surface of rail portion 3*f* of rocker/leg assembly 3*b*, and then fastening armrest/stile/riser assembly 2*b* to rocker/leg assembly 3*b* using screws or other suitable fastening means.

All joints in the present sleigh-type rocking chair are preferably assembled using waterproof glue.

When manufactured by the use of CNC router systems, the present sleigh-type rocking chair will be stronger by virtue of the inclusion of monolithic parts assemblies, precise joinery and unlimited scalability. Prior solutions included more parts, manually cut joinery and no scalability. Parts that required adjustment in prior solutions required either replacement of the entire part, or replacement of the production jig used to create it, namely, bending and gluing forms, and the like. Parts assemblies for the present sleigh-type rocking chair can be adjusted for size, as necessary or desirable, in a matter of minutes. The pre-laminated stock from which the assemblies are cut have inherently stronger structure by virtue of the long-grain to long-grain glue surface contact that is present in each piece. Precision joinery enables each portion of a surface to function as glue surface. The monolithic parts assemblies also reduce raw materials consumption substantially, not only because of the efficiency of the parts, but also because the need for trial, error and replacement is alleviated. The monolithic assemblies have also alleviated joints that were previously subject to failure.

Manufacturing the present sleigh-type rocking chair with monolithic parts assemblies using the present CNC technique achieves the following beneficial results:

(1) Reduction in production time by over 90%, to an estimated 2.5 hours per chair.

(2) Reduction in cost/unit significantly, thereby allowing expansion of the customer base to include many more people who could potentially afford purchase the product.

(3) Improvement of structural integrity by the use of monolithic parts and precision, machine-cut joinery. Ten manually produced joints that had existed in previous solutions have been eliminated in this solution. The joints that remain are prepared by a programmed machine.

(4) Reduction in manpower required to produce the product.

(5) Reduction in the amount of raw material consumed by over 30%.

(6) Reduction in the amount of energy wasted in cutting additional parts.

(7) Reduction in the error rate to near zero.

(8) Production of a consistent result with each chair manufactured.

(9) Allowing the offering of different sizes of chairs, without the need to retool.

(10) Job creation as sales grow and production increases.

The present CNC-based manufacturing method has the following advantages over the prior approaches:

(a) Previous solutions required in excess of 100 hours to produce a single chair.

(b) Previous solutions commanded a price point unattainable by most people.

(c) Previous solutions required more manually cut parts and their accompanying joinery. Manually cut joints that fit perfectly are very time consuming and require highly skilled, expensive laborers to produce.

(d) Previous solutions would require one laborer for every chair produced; that laborer would have to work 100 or more hours to produce a single chair.

(e) Previous solutions consumed more than 30% more raw material.

(f) Previous solutions require longer machine running times, higher utility costs, higher overhead.

(g) Previous solutions are subject to human error at some point on every given piece of the chair.

(h) Previous solutions produced multiple chairs, but the parts would not be interchangeable between chairs; each chair would have to be "custom-fit" for finishing.

(i) Previous solutions offered no easy way to alter the size of the chairs to accommodate larger or smaller customers.

(j) Previous solutions produced chairs very slowly, kept them expensive and greatly inhibited sales growth.

While particular elements, embodiments and applications of the present invention have been shown and described, it will be understood, that the invention is not limited thereto since modifications can be made by those skilled in the art without departing from the scope of the present disclosure, particularly in light of the foregoing teachings.

What is claimed is:

1. A method of forming components of a sleigh-type rocking chair, the method comprising:

forming a pair of armrest/stile/riser assemblies using a computer numerical control cutting device, each of said armrest/stile/riser assemblies formed having:

a first cooperating part of an armrest/stile/riser joint part on a bottom inside portion thereof, and a form-fitted overhang on a bottom inside portion thereof;

forming a pair of rocker/leg assemblies using a computer numerical control cutting device, each of said rocker/leg assemblies having:

a second cooperating part of a rocker/leg joint part formed on a top outside portion thereof, said rocker/leg joint part configured to be fastened onto said first cooperating part on the bottom inside portion of said armrest/stile/riser joint part, a first cooperating seat mortise and tenon joint part on a top inside portion thereof;

a rocker/leg assembly front mortise formed in a side portion thereof;

a rocker/leg assembly rear mortise formed in a side portion thereof;

forming a seat using a computer numerical control cutting device, said seat having:

a second cooperating seat mortise and tenon joint part formed on a side portion thereof, said second cooperating seat mortise and tenon joint part configured to be press fitted into said first cooperating seat mortise and tenon joint part on the side portion of said rocker/leg assembly, and a plurality of spindle mortises formed in a top portion thereof;

forming a front stretcher using a computer numerical control cutting device, said front stretcher to function as a monolithic tenon configured to be press fitted in each of said rocker/leg assembly front mortises;

forming a rear stretcher using a computer numerical control cutting device, said rear stretcher to function as a monolithic tenon configured to be press fitted in each of said rocker/leg assembly rear mortises;

forming a crest rail using a computer numerical control cutting device, said crest rail:

functioning as a monolithic tenon, and having a plurality of crest rail mortises formed on the bottom portion thereof;

forming a plurality of spindles using a computer numerical control cutting device, each of said spindles functioning as a monolithic tenon, one end of said spindles configured to be press fitted in said spindle mortises formed in said seat top portion and the other end of said spindle configured to be press fitted in said crest rail mortises.

2. The method of claim 1, wherein said first cooperating part of said joint on said armrest/stile/riser assembly bottom inside portion is an angled flat joint part and said second cooperating part of said joint formed on said rocker/leg assembly top outside portion is a square flat joint part.

3. The method of claim 1, wherein said first cooperating seat mortise and tenon joint part on said rocker/leg assembly to inside portion is a mortise joint part and said second cooperating seat mortise and tenon joint part formed on said seat side portion is a tenon joint part, said first and second cooperating seat mortise and tenon joint parts configured to be press fitted with each other.

* * * * *